United States Patent [19]

Thompson

[11] Patent Number: 4,936,119

[45] Date of Patent: Jun. 26, 1990

[54] VENTURI DEVICE FOR FLUID-JET DYEING APPARATUS

[75] Inventor: Jack E. Thompson, Rocky Mount, N.C.

[73] Assignee: Texfi Industries, Inc., Rocky Mount, N.C.

[21] Appl. No.: 347,465

[22] Filed: May 4, 1989

[51] Int. Cl.[5] ..... D06B 3/28

[52] U.S. Cl. ..... 68/178

[58] Field of Search ..... 68/177, 178, 181 R

[56] References Cited

U.S. PATENT DOCUMENTS

| | | | |
|---|---|---|---|
| 4,036,038 | 7/1977 | Aurich et al. | 68/178 X |
| 4,114,407 | 9/1978 | Turner et al. | 68/178 |
| 4,570,464 | 2/1986 | Thompson | 68/178 |
| 4,716,744 | 1/1988 | Turner et al. | 68/62 |

*Primary Examiner*—Philip R. Coe

*Attorney, Agent, or Firm*—Bell, Seltzer, Park & Gibson

[57] ABSTRACT

The venturi device is removably mounted within and concentrically of a venturi housing of the apparatus. It has a plurality of elongate fluid passageways located between the inner and outer cylindrical surfaces thereof, and extending substantially parallel to a central axis of the device and housing. The passageways are spaced from each other about the circumference of the venturi device, have fluid inlets their adjacent closed ends, and have open ends adjacent an outlet section of the device possessing a frusto-conical surface that extends at a preselected angle relative to the central axis and that directs streams of fluid discharged from the open ends of the passageways angularly toward the central axis.

18 Claims, 2 Drawing Sheets

VENTURI DEVICE FOR FLUID-JET DYEING APPARATUS

FIELD OF THE INVENTION

This invention relates to fabric dyeing or similar fluid-treating apparatuses having venturi devices through which textile fabric in continuous rope-like form is conducted by high velocity streams or "jets" of dye liquor or other fluid directed thereagainst. The invention more specifically relates to an improved venturi device for such an apparatus.

BACKGROUND OF THE INVENTION

As is pointed out in commonly-assigned U.S. Pat. No. 4,570,464, there are a number of attributes and/or features which should be possessed by a venturi device for a fabric dyeing apparatus of the above-described type. The device should be rapidly and easily mountable within and in true concentric relationship with the venturi housing of the apparatus. It should accurately control the preselected angle at which streams or jets of dye liquor impinge upon the fabric rope, since otherwise the rope may not be propelled at the desired rate, or might be damaged by the fluid jets, and/or might release an excessive amount of lint or the like into the dye liquor. In addition to other undesirable consequences, the latter result is undesirable since excessive lint may clog the venturi device, and additionally necessitates more frequent cleaning of filters associated with the apparatus, either of which requires removing the apparatus from operation while the necessary maintenance work is performed. Since excessive twisting of the fabric rope about its central axis may also damage the fabric and/or create a jam requiring removal of the apparatus from operation for maintenance, the venturi device should also minimize any tendency of its fluid jets to undergo spiraling or similar movement imparting twist to the fabric rope.

DESCRIPTION OF THE PRIOR ART

In addition to the above-noted U.S. Pat. No. 4,570,464, U.S. Pat. No. 4,716,744, and particularly the jet means 190 shown in FIGS. 20 and 21 thereof, may be of interest relative to the present invention.

SUMMARY OF THE INVENTION

The present invention provides an improved venturi device, for a fabric dyeing or similar apparatus of the previously described type having a venturi housing adapted to receive the device, possessing the desirable attributes and features previously noted, along with various practical benefits.

In a preferred embodiment thereof, the venturi device includes an elongate main body section, fabric inlet and outlet sections adjacent respective opposite ends of the main body section, and mounting means by which the device may be easily and quickly mounted within and in concentric relationship with the venturi housing of the dyeing apparatus. The main body of the device has inner and outer parallel cylindrical surfaces, fluid passageways intermediate such surfaces, and fluid inlet openings extending through the outer surfaces and communicating with respect ones of the fluid passageways. The passageways are spaced from each other about the circumference of the main body section of the device. Each passageway extends substantially parallel to the central axis of the device, has a closed end adjacent to the fabric inlet section of the device, and an open end adjacent the fabric outlet section of the device. The jets or streams of dye liquor passing at high velocity from the passageways impinge upon the inclined surface of a frusto-conical portion of the outlet section of the device and are deflected thereby so as to engage, at the preselected optimum angle of the inclined surface, the fabric rope extending through the device.

Preferably the passageways are of arcuate shape as viewed in transverse cross-section, and the fluid inlets thereof are offset from the fluid inlet of the venturi housing within which the device is removably mounted.

DESCRIPTION OF THE DRAWINGS

A preferred embodiment of the invention is illustrated by the accompanying drawings, in which.

DESCRIPTION OF THE PREFERRED EMBODIMENT

Figure 1:
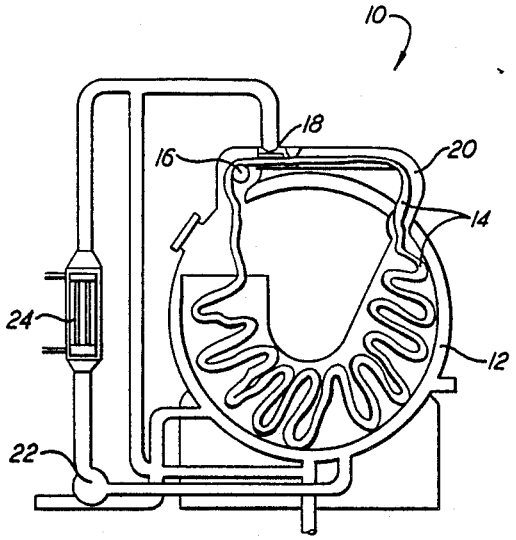
FIG. 1 is a partially schematic representation of a fabric dyeing apparatus having a venturi chamber containing a venturi device in accordance with the invention.

The fluid-jet dyeing apparatus 10 schematically shown in FIG. 1 is of the known type having a treatment vessel 12 containing suitable dye liquor or fluid (not shown) for dyeing or other otherwise treating textile fabric. Fabric 14 is in a continuous rope-like form and during operation of apparatus 10 is conducted through vessel 12 by conveying means that customarily includes a lifter reel 16 and a venturi-containing housing 18 associated with a fabric conduit 20 located atop, and communicating adjacent its opposite ends with, vessel 12. During operation of apparatus 10 dye liquor withdrawn from the lower part of vessel 12 is recirculated by a pump 22 and suitable piping, with which a heater 24 may be associated, to venturi housing 18.

Figure 2:
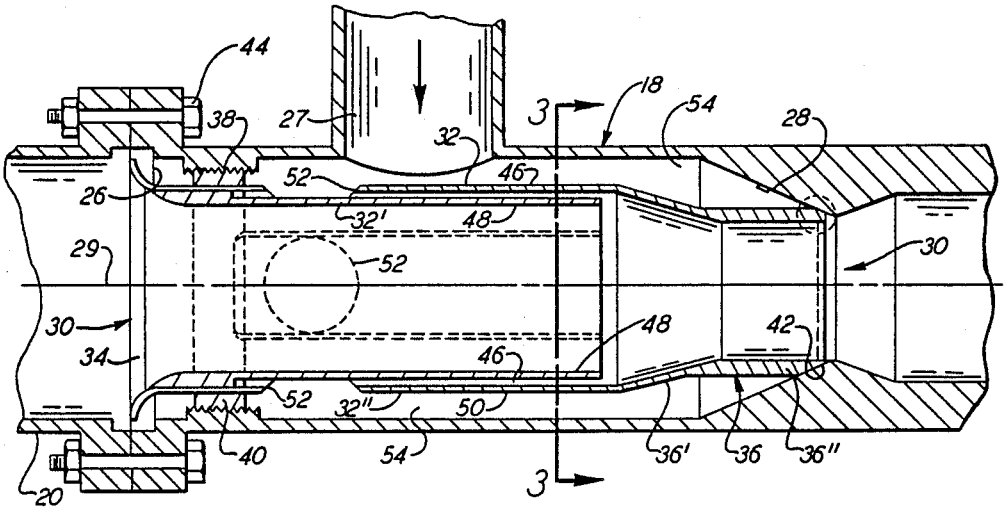
FIG. 2 is an enlarged view in longitudinal section of the venturi chamber and venturi device of the apparatus, some additional adjacent components of the apparatus also being fragmentarily shown.

Referring now also to FIG. 2 of the drawings, the tubular venturi housing 18 has a fabric inlet opening 26 and a fabric outlet 28 adjacent opposite ends thereof, and has intermediate its ends a fluid inlet 27 through which passes the dye liquor returned to the housing by pump 22 (FIG. 1). Fluid outlet 28 of housing 18 is of inwardly tapering frusto-conical shape. While the inner surface of fabric outlet 28 illustratively extends at an angle of approximately 25–30 degrees to the central axis 29 of housing 18, the angulation thereof may be of some greater or lesser magnitude.

A tubular venturi device 30 is releasably mounted within and concentrically of housing 18. Device 30 has a central elongate main body section 32, an outwardly flared fabric inlet section 34 adjacent one end thereof, and a constricted imperforate fabric outlet section 36 adjacent the opposite end thereof. Outlet section 36 has an inwardly-tapering frusto-conical portion 36' that is connected to or (as shown) formed integrally with main body section 32 and extends at a preselected desired angle relative to the central axis 29 of housing 18 and device 30. Outlet section 36 of the device also includes a cylindrical section 34", of smaller diameter than main body section 32, that is integral with and extends outwardly from tapered section 36'.

Figure 4:
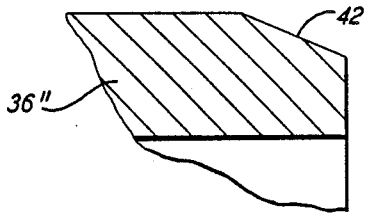
FIG. 4 is an enlarged fragmentary sectional view of that part of the free end of the fabric outlet section of the venturi device encircled by broken lines in FIG. 2.

The means by which venturi device 30 is concentrically mounted within housing 18 includes mating internally and externally threaded annular members 38, 40 respectively provided upon housing 18 and venturi 30 adjacent the fabric inlets thereof. The aforesaid mounting means preferably and illustratively further includes a beveled terminal surface 42 (best shown in FIG. 4) upon the free end of outlet section 36 of device 30. The slope of surface 42 is the same as that of outlet surface 28 of housing 18. Device 30 may be quickly and easily concentrically mounted within housing 18 by removing the connecting bolts 44 and adjacent section of fabric conduit 20, inserting device 30 into housing 18 sufficiently to establish mating threaded relationship between members 38,40, and then rotating device 30 about axis 29 so as to advance the beveled surface 42 upon outlet section 36 of the device into firm engagement with surface 28 of housing 18. Beveled surface 42 provides a self-centering camming action, following its engagement with housing surface 28, insuring that the venturi device's "downstream" end, as well as its "upstream" end, will be in concentric relationship with housing axis 29. The complementary slope and the substantial length of beveled surface 42 also assist in establishing a desired substantially fluid-tight sealed relationship between such surface and housing surface 28.

Figure 3:
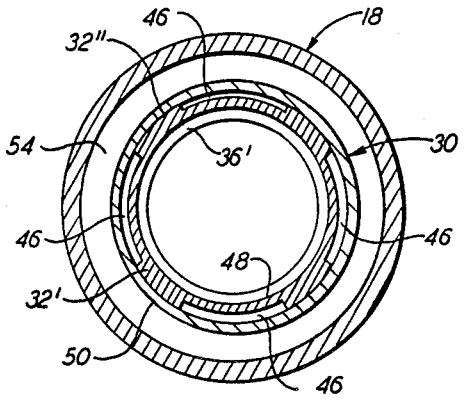
FIG. 3 is a transverse section, taken approximately along the line and in the direction of the arrows 3—3 of FIG. 2, through the venturi device and venturi housing.

Main body section 32 of venturi device 30 has a plurality (iilustratively four) of elongate passageways 46 extending therethrough between its respective inner and outer cylindrical surfaces 48,50, and also has a corresponding plurality of fluid inlet openings 52 communicating with respective ones of passageways 46. Passageways 46 are parallel to each other and to axis 29; and their length is approximately one-half of that of device 30. As is best shown in FIG. 3, passageways 46 are preferably and illustratively spaced substantially equally from each other about the circumference of section 32 of device 30, and each of them is of arcuate shape as viewed in transverse cross-section. The length of each passageway 46 is considerably greater than its width (i.e., its arcuate dimension), which in turn is considerably greater than the depth (i.e., radial dimension) of the passageway. The passageways 46 preferably collectively span at least approximately one-half of the circumference of venturi section 32. Each inlet opening 52 is located adjacent the closed (left, as viewed in FIG. 2) end of the passageway 46 with which it is associated, and extends through outer surface 50 of main body section 32 of venturi device 30. Preferably each opening is of circular shape and has a diameter approximately equal to the width of the passageway 46 with which it is associated. Openings 52 illustratively and preferably are offset along the length of axis 29 from fluid inlet 27 of housing 18, and may if desired also be otherwise nonaligned with inlet 27.

During operation of apparatus 10, the dye liquor fluid (not shown) pumped into housing 18 via its fluid inlet 27 fills the annular space 54 extending radially between venturi device 30 and the inner surface of housing 18, and that extends longitudinally between threaded members 38,40 at one end thereof, and the engaged surfaces 42,28 at the opposite end thereof. Such fluid then enters passageways 46 via their associated inlet openings 52, and passes along the length of the passageways to the open ends thereof adjacent outlet section 36 of device 30. The dimensions of each passageway are such as to substantially linearize the flow of the fluid passing through it. The jets or streams of fluid passing at high velocity from the open ends of passageways 46 impinge upon the thereto adjacent sloping surface of frusto-conical portion 36' of outlet section 36 of venturi device 30, and are deflected thereby angularly inwardly toward axis 29 and the fabric rope (not shown) then extending through the central portion of venturi device 30. The particular angle at which the fluid jets or streams impinge upon the fabric rope is determined by the preselected slope of frusto-conical portion 36' of fabric outlet section 36 relative to the central axis 29 of venturi device 30.

The optimum magnitude of the aforesaid slope and of other dimensions of venturi device 30 will differ depending upon the type of fabric being dyed, the desired speed of the fabric rope, the pump flow rate and other parameters, but can be ascertained for each particular dyeing operation. By way of illustration, the approximate dimensions of one venturi 30 in accordance with the invention are as follows: overall length, 13.5 inches; length, width and depth of passageways 46, 7.5 inches, 1.6 inches and 0.2 inches, respectively; diameter of passageway inlets, 1.6 inches; inner and outer diameter of main body section 32, 3.7 inches and 4.3 inches, respectively; length and minimum inner diameter of outlet section 36, 3.8 inches and 2.9 inches, respectively. When an appropriately dimensioned venturi 30 is employed, the fluid jets directed by it onto the fabric rope will move the same forwardly at the desired rate, while not damaging the fabric or generating excessive lint. In the latter regard, it has been ascertained that in at least some dyeing operations utilizing a venturi device of the present design, the amount of lint generated is so small that the lint filters customarily provided intermediate pump 22 and venturi housing 18 of dyeing apparatus 10 may be eliminated entirely. This greatly reduces the cost of the dyeing operation, since it eliminates the considerable apparatus down-time previously required for cleaning and/or replacement of such filters. Further reductions in apparatus down-time arise from the fact that venturi device 30 is less likely than the prior-art devices to become obstructed either by lint or the like within the dye liquor, or by "knotting" of the yarn rope due to twisting thereof. The latter result, i.e., reduced twisting of the fabric rope, is attributable in large part to the absence or at least marked reduction of "swirling" motion of the streams or jets of dye liquor directed against the fabric rope by the present venturi device.

To facilitate manufacture of venturi 30, its central section 32 may be and illustratively is formed by welding or similarly concentrically interconnecting inner and outer tubular members 32', 33" after forming passageway-defining slots within the exterior of inner member 32', and opening 52 within outer member 32".

Although a specific embodiment of the invention has been shown and described, this was for purposes of illustration only and not for purposes of limitation, the scope of the invention being in accordance with the following claims.

That which is claimed:

1. In an apparatus for the fluid treatment of textile fabric advanced therethrough in rope-like form, said apparatus including a tubular venturi housing having a central axis, a fabric inlet adjacent one end thereof, an inwardly tapering fabric outlet adjacent the opposite end thereof, and a fluid inlet intermediate said ends thereof, the improvement comprising:

a tubular venturi device including a main body section, a fabric inlet section adjacent one end of said main body section, and a fabric outlet section adjacent the opposite end of said main body section;

mounting means releasably mounting said venturi device within and in substantially concentric relationship with said venturi housing;

said main body section of said venturi device having inner and outer surfaces, elongate fluid passageways intermediate said surfaces, and fluid inlet openings extending through said outer surface of said main body section and communicating with said fluid passageways;

said fluid passageways being spaced from each other about the circumference of said main body section of said venturi device;

each of said passageways extending along a major part of the length of said main body section, being substantially parallel to said central axis, having a closed end adjacent said fabric inlet section of said device, and an open end adjacent said fabric outlet section of said device;

each of said fluid inlet openings of said device being disposed adjacent said closed end of the associated one of said passageways.

2. Apparatus as in claim 1, wherein said fluid inlet openings of said device correspond in number to and communicate with respective ones of said passageways, and are in offset relationship to said fluid inlet of said housing.

3. Apparatus as in claim 1, wherein each of said passageways is of arcuate shape as viewed in transverse cross section, and has a dimension in the circumferential direction of said main body section greater than its dimension in the radial direction of said main body section.

4. Apparatus as in claim 1, wherein said passageways are spaced substantially equally from each other about the circumference of said main body section.

5. Apparatus as in claim 4, wherein there are four of said passageways.

6. Apparatus as in claim 4, wherein said passageways collectively span at least approximately one-half of the circumference of said main body section.

7. Apparatus as in claim 1, wherein said main body section of said device is spaced radially from said housing and defines therewith part of an annular space located between said device and said housing, and communicating with said fluid inlet of said housing and with said fluid inlet openings of said device, said annular space being closed at opposite ends thereof such that fluid entering said space from said inlet of said housing is constrained to pass therefrom via said passageways.

8. Apparatus as in claim 1, wherein said means releasably mounting said device within said housing includes first cooperating elements upon said device and said housing adjacent said fabric inlet of said housing, and second cooperating elements upon said device and said housing adjacent said fabric outlet of said housing, said first and second cooperating elements preventing fluid introduced into said housing through said fluid inlet from passing out of said housing other than via said passageways.

9. Apparatus as in claim 1, wherein said means mounting said device within said housing includes a continuous annular surface upon and adjacent the free end of said fabric outlet section of said device, said surface being in substantially fluid-tight abutting relationship along the entire extent thereof with the surface of said tapering fabric outlet of said housing.

10. Apparatus as in claim 9, wherein the abutting surfaces of said device and said housing are substantially parallel.

11. Apparatus as in claim 1, wherein said fabric outlet section of said device includes a tubular frusto-conical portion connected to and extending angularly from said central section of said device towards said central axis, and a substantially cylindrical imperforate portion connected to it and extending from said frusto-conical portion toward and into substantially fluid-tight sealed engagement with said inwardly tapering fabric outlet of said housing.

12. Apparatus as in claim 1, wherein at least some of said fluid inlet openings of said device are offset in the longitudinal direction of said housing from said fluid inlet of said housing.

13. Apparatus as in claim 12, wherein all of said fluid inlet openings of said device are offset in the longitudinal direction of said housing from said fluid inlet of said housing.

14. Apparatus as in claim 1, wherein at least some of said fluid inlet openings of said housing have central axes extending in nonparallel relationship to the central axis of said fluid inlet of said housing.

15. Apparatus as in claim 1, wherein said fluid inlet openings of said device are of generally circular shape and have a diameter approximately equal to the width of said passageways.

16. In an apparatus for the fluid treatment of textile fabric advanced therethrough in rope-like form, said apparatus including a tubular venturi housing having a central axis, a fabric inlet adjacent one end thereof, an inwardly tapering fabric outlet adjacent the opposite end thereof, and a fluid inlet intermediate said ends thereof, the improvement comprising:

a tubular venturi device including a main body section, a fabric inlet section adjacent one end of said main body section, and a fabric outlet section adjacent the opposite end of said main body section;

mounting means releasably mounting said venturi device within and in substantially concentric relationship with said venturi housing;

said main body section of said venturi device having inner and outer surfaces, elongate fluid passageways intermediate said surfaces, and fluid inlet means extending through said outer surface of said main body section and communicating with said fluid passageways;

said fluid passageways being spaced from each other about the circumference of said main body section of said venturi device, each of said passageways extending substantially parallel to said central axis and having a closed end adjacent said fabric inlet section of said device, and an open end adjacent said fabric outlet section of said device;

said fluid inlet means of said device being disposed adjacent said closed ends of said passageways.

17. Apparatus as in claim 16, wherein said means releasably mounting said device within said housing includes first cooperating elements upon said device and said housing adjacent said fabric inlet of said housing, and second cooperating elements upon said device and said housing adjacent said fabric outlet of said housing, said first and second cooperating elements preventing fluid introduced into said housing through said fluid inlet from passing out of said housing other than via said passageways.

18. Apparatus as in claim 16, wherein said means mounting said device within said housing includes a continuous annular surface upon and adjacent the free end of said fabric outlet section of said device, said surface being in substantially fluid-tight abutting relationship along the entire extent thereof with the surface of said tapering fabric outlet of said housing.

* * * * *